United States Patent [19]

Brückl et al.

[11] 4,214,733

[45] Jul. 29, 1980

[54] DEVICE FOR TENSIONING CORONA-DISCHARGE WIRES

[75] Inventors: Konrad Brückl; Georg Fryda, both of Munich, Fed. Rep. of Germany

[73] Assignee: AGFA-Gevaert, A.G., Leverkusen, Fed. Rep. of Germany

[21] Appl. No.: 43,302

[22] Filed: May 29, 1979

[51] Int. Cl.[3] ..... A63B 61/04

[52] U.S. Cl. ..... 339/274; 24/131 C; 256/40

[58] Field of Search ..... 254/161, 162, 163, 164, 254/165; 242/75, 75.3, 96, 125, 125.1; 24/115 R, 131 R; 226/195

[56] References Cited

U.S. PATENT DOCUMENTS

| | | | |
|---|---|---|---|
| 1,272,944 | 7/1918 | Green | 254/161 |
| 2,348,487 | 5/1944 | McKay | 254/161 |
| 2,586,048 | 2/1952 | Hyatt | 254/161 |
| 3,416,763 | 12/1968 | Moreno | 254/161 X |

*Primary Examiner*—Edward J. McCarthy
*Attorney, Agent, or Firm*—Michael J. Striker

[57] ABSTRACT

A device for tensioning the corona-discharge wires of e.g. electrostatic copiers has an internally toothed sleeve member in which an externally toothed clamping member is turnably received. Both members have openings transverse to the longitudinal axis of the sleeve member. When an end portion of a corona wire whose other end is fixedly secured, is inserted through both openings in aligned condition of the same, turning of the clamping member draws the end portion between the members, tensioning the wire and clamping the end portion between the teeth of the members.

14 Claims, 2 Drawing Figures

DEVICE FOR TENSIONING CORONA-DISCHARGE WIRES

BACKGROUND OF THE INVENTION

1. Field of the Invention

The present invention relates to a wire-tensioning device.

More particularly, the invention relates to a device for tensioning corona-discharge wires.

Still more specifically, the invention relates to a device for tensioning corona-discharge wires such as are used in electrostatic copiers.

2. The Prior Art

For reasons known to those skilled in the art it is necessary for corona-discharge wires to be taut, i.e. not to have any slack. This is true particularly, although not exclusively, in electrostatic copying machines.

Devices for this purpose are already known, for example from German allowed application No. 2,641,396. In the device disclosed therein the free end of a corona wire (the other end is secured in suitable manner so as to be fixed) is engaged and the wire at the same time tensioned by means of a wedge which is inserted transversely to the elongation of the wire into a slightly conical opening. However, such an arrangement can transmit only a relatively limited tension to the wire since tensile forces acting in the longitudinal (i.e. tensioning) direction of the wire can in effect occur only at that edge at which the wire end portion entering beneath the wedge is first engaged and clamped by the wedge. This is understandable because, if it were not the first wire end engaged by the wedge which is clamped without freedom of escaping movement, then the tensioned wire would be capable of lifting the wedge out of its seat. There is, therefore, only a single clamping edge or point in this arrangement, and this in turn means that where the material is engaged at this single point the material of the wire can begin to flow under the very strong stresses acting upon it at this point, with the result that the originally achieved degree of tensioning deteriorates over a period of time, and sometimes deteriorates very rapidly.

SUMMARY OF THE INVENTION

It is, accordingly, an object of the present invention to provide an improved corona-discharge wire tensioning device which avoids disadvantages encountered in the prior art.

More particularly, it is an object of the present invention to provide such an improved corona-discharge wire tensioning device which makes it possible to tension the discharge wire to any desired degree without permitting slackening of the tension due to flowing of the wire material or to other causes.

Pursuant to these objects, and others which will become apparent hereafter, one aspect of the invention resides in a device for tensioning corona-discharge wires which are fixedly secured at one end, particularly for use in electrostatic copiers. Briefly stated, such a device may comprise an internally toothed sleeve member and an externally toothed clamping member which is received within the sleeve member. Each of these members has a transverse opening inclined to the longitudinal axis of the sleeve member so that, when a free end portion of a corona-discharge wire is inserted through both of the openings when the same are in registry and the members are thereupon turned relative to one another, the free end portion of the wire will be drawn and become clamped between the teeth of the members under simultaneous tensioning of the wire.

It will be appreciated that with this arrangement it is possible, by turning of the clamping member, to impart to the wire a tensioning movement—and therefore a degree of tensioning—which can be selected at will. The free wire end inserted into the registering openings will, when relative turning of the sleeve member and clamping member is effected, become wound about the clamping member and thus drawn into the device. After a relatively small angular displacement of the two members relative to one another (usually of the clamping member to the sleeve member) the wire will already be clamped at a plurality of edges constituted by the internal and external teeth of the members. The tension acting in the wire is transmitted from tooth to tooth and, due to the tendency to turn the clamping member backwards counter to the arresting action of the teeth, the clamping effect at the individual edges engaging the wire is even further increased. Since the fire wire end is drawn into the device it will be appreciated that double the number of effective clamping edges is available until this free wire end is totally received in the device. In addition, this drawing-in of the free wire end has the further advantage that any danger of an unintended contacting of the free wire end with conductive or current-conducting components becomes the smaller, the more the wire is tensioned and, consequently, the more the free end portion of the wire is drawn into the device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
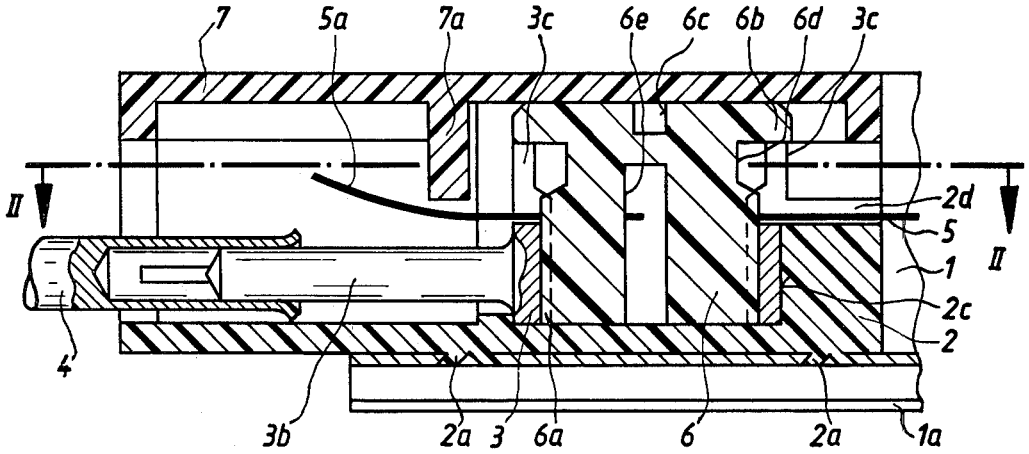
FIG. 1 is a section through a device embodying the invention, taken on line I—I of FIG. 2.
Figure 2:
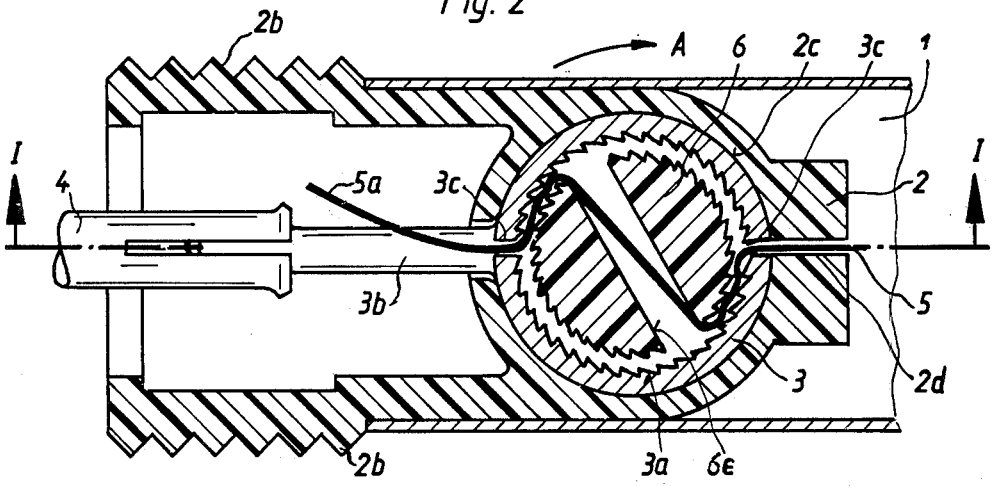
FIG. 2 is a section taken on line II—II of FIG. 1.

An examplary embodiment of the device according to the present invention is illustrated in FIGS. 1 and 2 which show different sections. The device includes a profiled member 1 of metallic material, for example aluminum, which is of essentially U-shaped configuration and serves as the corona housing. Inserted into the housing 1 is an insulating member or support 2 which is constituted of an electrically insulating synthetic plastic material, for example the polycarbonate which is commercially available under the tradename "Makrolin". The lower part of the housing 1 has L-shaped guide rails 1*a* which can be inserted into a holding member for the housing 1, in known manner. The holding member and, in fact, details of an electrostatic copier with which the device according to the invention can be used, are not illustrated because they do not form a part of the present invention. The purpose of providing the rails, however, is so that the device can be readily inserted into and withdrawn from the holding member which in turn is a part of a larger device, for example an electrostatic copier, so that the device according to the present invention—and in fact the entire corona discharge device—can be readily removed for inspection and cleaning.

The drawing shows that the member 2 is connected with the member 1 by means of portions 2*a* which are upset in rivet-like manner in openings of the member 1. The member 2 is further provided with a handle 2*b* formed with serrations or the like but extends from the end of the member 1 and which can be engaged to facilitate the withdrawal of the member 1 and its associated components. The serration facilitates gripping. The member 2 is further provided with an opening 2*c* into which a metallic sleeve 3 is inserted. The inner circumferential surface of the sleeve 3 is provided with an annulus of teeth 3*a* which in the illustrated embodiment are of sawtooth-shaped cross-section but need not have this particular cross-section. Member 3 is provided with a contact pin 3*b* which may but need not be of one piece with it and onto which a slotted socket 4 can be pushed which serves to supply electrical energy for the corona wire. The upper edge of the sleeve 3 is provided with a transversely extending slot 3*c* into which a corona wire 5 to be tensioned can be placed.

Received within the sleeve 3 is a clamping member 6 which is here of generally cylindrical configuration and provided with an outer annulus of teeth 6*a;* again, the teeth 6*a* are of sawtooth-shaped cross-section but could have a different cross-section. The member 6 is of an electrically insulating synthetic plastic material, preferably of a polycarbonate such as the commercially available product called "Makrolin" mentioned above and of which the member 2 may also be made. The upper end portion of the member 6 is provided with a head 6*b* formed with a slot 6*c* into which a screwdriver or analogous bladed tool may be inserted which serves to turn the member 6 within the sleeve 3. Intermediate the head 6*b* and the portion provided with the teeth 6*a* the member 6 is formed with a circumferential recess 6*d,* i.e. the teeth 6*a* have their uppermost ends located at some distance from the head 6*b.*

As FIGS. 1 and 2 both show, that axially extending portion of the member 6 which is provided at the exterior with the teeth 6*a* is formed with a slot 6*e* which subdivides it into two halves and extends upwardly to the region of the recess 6*d.* The purpose of this is to allow the member 6 over its entire axial portion which is provided with the teeth 6*a,* an elastic "springy" movement in radial direction. This means that when the member 6 is turned in the direction of the arrow A (see FIG. 2) the sawtooth-shaped teeth 6*a* of the member 6 can snap behind the sawtooth-shaped teeth 3*a* of the member 3. This makes it possible to very readily turn the member 6 relative to the member 3 by a distance corresponding to one tooth at a time, and the cooperating teeth 3*a* and 6*a* prevent a reverse turning of the member 6 (i.e. counter to the direction of the arrow A) under the tension of the corona wire 5 which is being stretched. The springy arrangement of the member 6 permits it, or rather permits the two halves of the member 6, to yield sufficiently in inward direction so that one or more convolutions of the wire 5 can become accommodated between the teeth 3*a* and 6*a;* this is clearly visible in FIG. 2.

When a corona wire 5 is to be tensioned the same is so placed into the slots 3*c* of the sleeve 3 and a slot 2*d* formed in the member 2, that a small free end portion 5*a* of the wire extends out from and beyond the sleeve 3. The member 6 is then so inserted into the sleeve 3 that the slot 6*e* of the member 6 is aligned with the slots 2*d* of member 2 and 3*c* of member 3. Subsequent turning of the member 6 in the direction of the arrow A, e.g. by means of a tool inserted into the slot 6*c,* causes the corona wire 5 to be tensioned in that it is pulled into the sleeve (in leftward direction in FIG. 2) whereas at the same time the projecting free end portion 5*a* is also pulled into the sleeve 3 (rightwards in FIG. 2). The portions of the wire which are thus drawn between the teeth 3*a* and 6*a* become clamped between them and are engaged by a number of teeth which is the greater the more of the wire is drawn into the sleeve.

When the wire 5 has been tensioned to the requisite degree an electrically insulating cover 7 (which may again be of the trademarked material "Makrolin" or another electrically insulating synthetic plastic material) is then placed onto the device so as to protect the device against engagement by a user or operator to eliminate the danger of injury from shock; this is particularly important if a part of the free end portion 5*a* is still located outside the sleeve 3. A projection 7*a* of the cover 7 engages and holds stern the wire 5 when the cover 7 is put in place, thus preventing the wire 5 from slipping, e.g. axially (see FIG. 1) of the member 6 out of the space between the teeth 3*a* and 6*a.*

Of course, the teeth 3*a* and 6*a* need not be of sawtooth-shaped cross-section. However, if they do have this cross-section this is particularly advantageous because it offers an especially high degree of resistance to reverse turning (counter to the arrow A) of the member 6 under the tension exerted upon it by the tensioned wire 5. It is also possible for the sleeve to be radially yieldable, instead of the member 6, and it will be appreciated that instead of the slot 6*c* for insertion of a blade 2 some other configuration could be chosen, for example a head 6*b* which would extend farther upwardly than illustrated in FIG. 1 and which would be of e.g. hexagonal outline for engagement with a wedge. Combinations of materials different from those which have been described above are conceivable. It has been found, however, that a particularly good tensioning effect with very low tendency for slackening over prolonged periods of time is achieved if it is the member 6 which is made of synthetic plastic material and if the sleeve 3 is of metallic material. The members 3 and 6 need of course not be mounted on the member 2 in the particular manner illustrated, nor need the member 2 be connected with the member 1 in the specific illustrated way. The use of the cover 7 is also optional, but highly advantageous because it provides an added safety factor all by itself, and the provision of the holding-down projection 7*a* for the wire 5 adds to this a further margin of safety against undesired touching of the wire 5 by a user or operator.

While the invention has been illustrated and described as embodied in a device for tensioning corona-discharge wires, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for tensioning corona-discharge wires which are fixedly secured at one end, particularly for use in electrostatic copiers, a combination comprising an internally toothed sleeve member; and an externally toothed clamping member received within said sleeve member, each of said members having a transverse opening inclined to the longitudinal axis of said sleeve member so that, when a free end portion of a corona-discharge wire is inserted through both said openings when the same are in registry and the members are thereupon turned relative to one another, the free end portion of the wire will be drawn and become clamped between the teeth of said members under simultaneous tensioning of the wire.

2. A combination as defined in claim 1, wherein said sleeve member is stationary and said clamping member is turnable relative to the sleeve member.

3. A combination as defined in claim 1, wherein the teeth of at least one of said members are of sawtooth-shaped cross-section.

4. A combination as defined in claim 1, wherein at least one of said members is resiliently yieldable in radial direction.

5. A combination as defined in claim 1, wherein said clamping member is provided with a transverse slit in at least that longitudinal part of the clamping member which is provided with the external teeth.

6. A combination as defined in claim 1; and further comprising an operating portion on one of said members for effecting turning of the same relative to the other member.

7. A combination as defined in claim 6, wherein said operating portion is on said clamping member.

8. A combination as defined in claim 6, said clamping member having a part projecting axially from said sleeve, and said operating portion being a slot formed in said part for insertion of a bladed torque-transmitting tool.

9. A combination as defined in claim 1, wherein said clamping member is of electrically insulating synthetic plastic material, and said sleeve member is of metallic material.

10. A combination as defined in claim 9; further comprising a support of electrically insulating material for said sleeve member; and electrical contacts on said sleeve member for connecting the same to a source of electrical energy.

11. A combination as defined in claim 10; and a metallic element accommodating said support and constituting a corona housing.

12. A combination as defined in claim 11, said support having a portion extending from said corona housing and provided with a handle.

13. A combination as defined in claim 11; and further comprising a cover of electrically insulating material shielding portions of said support which are located outside said housing.

14. A combination as defined in claim 13, said cover having at least one portion adapted to engage and hold in place a corona-discharge wire having an end portion engaged by said members.

* * * * *

UNITED STATES PATENT AND TRADEMARK OFFICE

CERTIFICATE OF CORRECTION

PATENT NO. : 4,214,733

DATED : July 29, 1980

INVENTOR(S) : Konrad Bruckl and Georg Fryda

It is certified that error appears in the above-identified patent and that said Letters Patent is hereby corrected as shown below:

On the title page Insert:

-- (30) Foriegn Application Priority Data

June 8, 1978 Germany 2825104 --.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*